United States Patent [19]

Kimble et al.

[11] Patent Number: 4,643,823

[45] Date of Patent: Feb. 17, 1987

[54] RECOVERING METAL SULFIDES BY FLOTATION USING MERCAPTOALCOHOLS

[75] Inventors: James B. Kimble; Robert M. Parlman, both of Bartlesville, Okla.

[73] Assignee: Phillips Petroleum Company, Bartlesville, Okla.

[21] Appl. No.: 416,757

[22] Filed: Sep. 10, 1982

[51] Int. Cl.[4] ..... B03D 1/14

[52] U.S. Cl. ..... 209/166; 252/61

[58] Field of Search ..... 209/166, 167; 252/60, 252/61; 568/62

[56] References Cited

U.S. PATENT DOCUMENTS

| | | | |
|---|---|---|---|
| 2,012,609 | 8/1935 | Lenher | 209/166 |
| 2,750,254 | 6/1956 | Blake | 23/14.5 |
| 3,394,192 | 7/1968 | Jones | 260/609 |
| 3,469,692 | 9/1969 | Freyberger | 209/166 |
| 3,785,488 | 1/1974 | Werneke | 209/167 |
| 4,211,644 | 7/1980 | Wiechers | 209/166 |
| 4,274,950 | 6/1981 | Larribau et al. | 252/61 |
| 4,295,962 | 10/1981 | Parlman et al. | 209/167 |
| 4,416,770 | 11/1983 | Bresson et al. | 209/167 |

FOREIGN PATENT DOCUMENTS

| | | | |
|---|---|---|---|
| 739765 | 4/1970 | Belgium | 568/62 |

*Primary Examiner*—Bernard Nozick

*Attorney, Agent, or Firm*—A. W. Umphlett

[57] ABSTRACT

A process for recovering a metal sulfide mineral from ore by froth flotation using 1-alkyl substituted-2-mercaptoethanol as the flotation agent.

3 Claims, No Drawings

RECOVERING METAL SULFIDES BY FLOTATION USING MERCAPTOALCOHOLS

BACKGROUND OF THE INVENTION

This invention relates to flotation processes for recovering minerals from their ores. In another aspect of the invention, it relates to recovery of metal sulfide minerals from their ores. In another aspect of the invention, it relates to the use of flotation agents and recovery of minerals from their ores.

Froth flotation is a process for concentrating minerals from ores. In a froth flotation process, the ore is crushed and wet ground to obtain a pulp. Additives such as mineral flotation or collecting agents and frothing agents are added to the pulp to assist in subsequent flotation steps and the valuable minerals are separated from the undesired, or gangue, portions of the ore. After flotation agents are added, the pulp is aerated to produce a froth. The minerals which adhere to the bubbles of froth are skimmed or otherwise removed and the mineral-adhering froth is collected and further processed to obtain the desired minerals. The essence of the present invention is to provide an alternative family of flotation agents for metal sulfide minerals.

It is therefore an object of this invention to provide compounds suitable as flotation agents for metal sulfide minerals for use in ore flotation processes. It is another object of this invention to provide a method for recovering metal sulfide minerals from their ores using ore flotation processes. It is still another object of this invention to provide ore separation processes employing flotation agents.

Other aspects, objects and the various advantages of this invention will become apparent upon reading this specification and the appended claims.

STATEMENT OF THE INVENTION

According to this invention, a process is provided for recovering metal sulfide mineral from ores. In the process, ore containing metal sulfide mineral is admixed in a froth flotation process with an amount of 1-alkyl substituted-2-mercaptoethanol sufficient to aid in the flotation of the metal sulfide minerals so that metal sulfide minerals can be recovered from the flotation slurry.

In one embodiment of the invention, a metallurgical concentrate containing metal sulfide minerals is obtained from the froth of a flotation process which employs 1-alkyl substituted-2-mercaptoethanol as flotation agent to separate the metal sulfide minerals from the flotation slurry.

The 1-alkyl substituted-2-mercaptoethanol compounds useful in the invention are represented by the formula

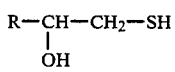

wherein R can be any alkyl radical having from 1 to 18 carbon atoms. Examples of these compounds which can also be called 2-hydroxy-1-alkanethiols are 2-hydroxy-1-propanethiol, 2-hydroxy-1-butanethiol, 2-hydroxy-1-hexanethiol, 2-hydroxy-1-decanethiol, 2-hydroxy-1-dodecanethiol, 2-hydroxy-1-eicosanethiol, and the like.

The hydroxyalkanethiols are readily prepared by known methods such as by epoxidation of olefins, particularly 1-olefins, followed by reaction with hydrogen sulfide. The compounds can also be made by substitution of —SH for halogen in halo alcohols.

Although the amount of flotation agent employed can vary considerably depending on the pH and the metal sulfide being floated, generally, the hydroxyalkanethiol flotation agents will be used in a range of about 0.005 pound/ton of ore to about 0.5 pound/ton of ore.

Any metal sulfide bearing ore is within the scope of this invention. Some metal sulfide minerals which are within the scope of this invention, although this is but a partial list, are the following:

| |
|---|
| Covallite ($CuS$) |
| Chalcocite ($Cu_2S$) |
| Chalcopyrite ($CuFeS_2$) |
| Bornite ($Cu_5FeS_4$) |
| Cubanite ($Cu_2SFe_4S_5$) |
| Valeriite ($Cu_2Fe_4S_7$) or ($Cu_3Fe_4S_7$) |
| Enargite ($Cu_3AsS_4$) |
| Tetrahydrite ($Cu_3SbS_2$) |
| Tennanite ($Cu_{12}As_4S_{13}$) |
| Stibnite ($Sb_2S_3$) |
| Sphalerite ($ZnS$) |
| Molybdenite ($MoS_2$) |
| Argentite ($Ag_2S$) |
| Stephanite ($Ag_5SbS_4$) |
| Daubreelite ($FeSCr_2S_3$) |
| Cooperite ($Pt(AsS)_2$) |
| Stannite ($Cu_3FeSSnS_2$) |
| Teallite ($TeSnS_2$) |

Metal sulfide minerals are often associated with other valuable ores which can be separated together from gangue or waste material during an initial flotation process or which can be separated in the initial flotation process by using depressants. The flotation agents of the present invention can be used with suitable flotation depressants for separation of valuable ores.

Any froth flotation apparatus can be used in this invention. The most commonly used commercial flotation machines are the Agitair (Gallagher Company), Denver (Denver Equipment Company), and the Fagergren (Western Machinery Company). Smaller, laboratory scale apparatus such as a Hallimond cell, can also be used.

The instant invention was demonstrated in tests conducted at ambient room temperature and atmospheric pressure. However, any temperature or pressure generally employed by those skilled in the art are within the scope of this invention.

The following examples serve to illustrate operability of this invention. A Hallimond cell was used in these examples. This cell is used as a screening method and generally employs pure minerals. On the other hand, commercial cells (e.g., Denver) employ ores in which the mineral is only a portion, sometimes a very small portion, of the total material. The amount of collector used is generally referred to as based on the amount of ore even though in the Hallimond cell concentration of flotation agents is reported in milligram per liter.

EXAMPLE I

This Example is a control that demonstrates the procedures used herein to evaluate the mineral collectors described and also to illustrate the effectiveness of a known collector in floating various types of sulfide ores. To a 70 milliliter capacity Hallimond cell was charged 1 gram of granulated chalcocite ($Cu_2S$), 2.8 milligrams (30 milligrams/liter) of potassium amyl xanthate (KAX) and about 69 milliliters of demineralized water (pH=6.5, resistivity>1 million Ω) and enough 10 weight percent aqueous NaOH to maintain the pH at 9.04. The mineral was conditioned in the cup for 5 minutes while magnetic agitation was applied and maintained constant by a magnetic field, revolving at 800 rpm. A flow of nitrogen, measured by a calibrated capillary (F and P Co., Precision Bore Flowrator Tube No. 08F-1/16-08-5/36) was also maintained constant at 4 cfs. A volume of 100 milliliters of demineralized water, adjusted to a 9.04 pH with aqueous NaOH was then introduced into the cell. Flotation was maintained for 10 minutes using the same value of nitrogen flow, 4 cfs, but with 700 rpm agitation; the pH remained unchanged. The floated fractions were recovered, over dried at 82° C. (180° F.) for 24 hours and weighed. There was obtained 1.0 gram of chalcocite to demonstrate that 100 percent of the chalcocite was floated with KAX. Repeating the procedure with 15 mg/liter KAX also gave a 100 percent recovery of chalcocite.

The procedure described above was repeated with KAX at the two concentrations but using chalcopyrite ($CuFeS_2$) instead of chalcocite. The results obtained showed 76 percent of the chalcopyrite floated at 30 mg/liter KAX and 48 percent floated at 15 mg/liter KAX.

EXAMPLE II

This example is a control wherein a low molecular weight mercaptoalkanol was used as the collector. The procedure described in Example I was repeated except 2-mercaptoethanol (also called beta mercaptoethanol and referred to as BME) was used in place of KAX. The results indicated a very low recovery of both chalcocite and chalcopyrite. When BME was used at a dosage level of 30 mg/liter there was obtained a 2 percent recovery by flotation of both chalcocite and chalcopyrite.

EXAMPLE III

This example is the invention wherein it was demonstrated that a 1-alkyl substituted 2-mercaptoethanol serves as a flotation agent in the separation of many sulfided ores. The procedure described in Example I was repeated except KAX was replaced with 2-hydroxy-1-dodecanethiol. The results show the inventive 1-alkyl substituted mercaptoalkanol gives about equal performance to KAX when floating chalcocite and is superior to KAX when floating chalcopyrite. The data also suggests a lower concentration of the substituted mercaptoalkanol can be used to give a performance equal to that for KAX. In addition, to chalcocite and chalcopyrite, the mercaptoalkanol is useful in floating other minerals. This data is listed in Table I along with data from the controls in Examples I and II for comparison.

TABLE I

Froth Flotation - Hallimond Cell

| Mineral[a] | Collector Conc. mg/L | % Recovery Control KAX[b] | % Recovery Control BME[c] | % Recovery Invention HDT[d] |
|---|---|---|---|---|
| 1. Chalcocite, $Cu_2S$ | 30 | 100 | 2 | — |
| | 15 | 100 | — | 97 |
| | 7.5 | — | — | 95 |
| 2. Chalcopyrite, $CuFeS_2$ | 30 | 76 | 2 | — |
| | 15 | 48 | — | 96 |
| | 7.5 | — | — | 92 |
| 3. Pyrite, $FeS_2$ | 15 | — | — | 97 |
| | 7.5 | — | — | 87 |
| 4. Galena, PbS | 15 | — | — | 89 |
| | 7.5 | — | — | 73 |
| 5. Sphalerite, ZnS | 15 | — | — | 98 |
| | 7.5 | — | — | 84 |

[a]Pure Mineral used, 1 gram.
[b]Potassium amyl xanthate.
[c]Beta-Mercaptoethanol.
[d]2-Hydroxy-1-dodecanethiol.

Data in the table above illustrate the effectiveness of 2-hydroxy-1-dodecanethiol, a compound exemplary of those useful in the present invention, as a flotation agent for various metal sulfide minerals.

We claim:

1. A process for recovering a metallurgical concentrate containing metal sulfide minerals in the froth of a flotation process, said process comprising in a froth flotation process admixing a flotation slurry containing metal sulfide ore with 2-hydroxy-1-dodecanethiol in an amount sufficient to aid in the flotation of said metal sulfide minerals and recovering said floated minerals from the gangue.

2. A process of claim 1 in which the amount of 2-hydroxy-1-dodecanethiol employed is in the range of about 0.005 pound/ton ore to about 0.5 pound/ton ore.

3. A method of claim 1 wherein said metal sulfide mineral is chosen from among the group consisting essentially of Covallite (CuS), Chalcocite ($Cu_2S$), Chalcopyrite ($CuFeS_2$), Bornite ($Cu_5FeS_4$), Cubanite ($Cu_2S$-$Fe_4S_5$), Valeriite ($Cu_2Fe_4S_7$) or ($Cu_3Fe_4S_7$), Enargite ($Cu_3AsS_4$), Tetrahydrite ($Cu_3SbS_2$), Tennanite ($Cu_{1.2}As_4S_{13}$), Stibnite ($Sb_2S_3$), Sphalerite (ZnS), Molybdenite ($MoS_2$), Argentite ($Ag_2S$), Stephanite ($Ag_5SbS_4$), Daubreelite ($FeSCr_2S_3$), Cooperite ($Pt(AsS)_2$), Stannite ($Cu_3SFeSnS_2$), and Teallite ($TeSnS_2$).

* * * * *